US011638509B2

(12) United States Patent
Ryu et al.

(10) Patent No.: US 11,638,509 B2
(45) Date of Patent: May 2, 2023

(54) VACUUM CLEANER

(71) Applicant: LG ELECTRONICS INC., Seoul (KR)

(72) Inventors: Jungwan Ryu, Seoul (KR); Jinhyouk Shin, Seoul (KR); Dae Ho Chang, Seoul (KR); Hyo Chul Shin, Seoul (KR); Kyoungho Ryou, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 163 days.

(21) Appl. No.: 16/985,263

(22) Filed: Aug. 5, 2020

(65) Prior Publication Data

US 2021/0161344 A1 Jun. 3, 2021

(30) Foreign Application Priority Data

Nov. 29, 2019 (KR) ..... 10-2019-0157469

(51) Int. Cl.
*A47L 9/16* (2006.01)
*A47L 9/12* (2006.01)
(Continued)

(52) U.S. Cl.
CPC ..... *A47L 9/1691* (2013.01); *A47L 5/36* (2013.01); *A47L 9/127* (2013.01); *A47L 9/1409* (2013.01);
(Continued)

(58) Field of Classification Search
CPC .... A47L 9/1608; A47L 9/1666; A47L 9/1683; A47L 9/22; A47L 9/2884; A47L 9/322;
(Continued)

(56) References Cited

U.S. PATENT DOCUMENTS 8,292,979 B2 * 10/2012 Conrad ..... A47L 5/28 55/467
9,451,858 B2 * 9/2016 Stickney ..... A47L 9/106
(Continued)

FOREIGN PATENT DOCUMENTS

JP 2010-094438 A 4/2010
KR 10-0944746 B1 3/2010
(Continued)

OTHER PUBLICATIONS

International Search Report, dated Sep. 1, 2020, issued in International Application No. PCT/KR2020/007096 (3 pages).
(Continued)

*Primary Examiner* — Brian D Keller
*Assistant Examiner* — Christopher Soto
(74) *Attorney, Agent, or Firm* — Birch, Stewart, Kolasch & Birch, LLP

(57) ABSTRACT

A vacuum cleaner includes a body having a space that allows air to flow therethrough. The vacuum cleaner includes a suction inlet that introduces the air into the body and a first cyclone in the body. The first cyclone separates foreign substances from the air introduced into the suction inlet. The vacuum cleaner includes a dust separation module having a filter unit that separates foreign substances from the air introduced from the first cyclone. The dust separation module also includes a second cyclone arranged within and separated from the filter unit. The second cyclone includes a cyclone base, a storage unit arranged adjacent to a lower portion of the second cyclone, and a cyclone array coupled to the cyclone base. The cyclone array allows the air to pass through an upper portion of the second cyclone and discharge the foreign substances collected by the second cyclone to the storage unit.

19 Claims, 15 Drawing Sheets

(51) Int. Cl.
*A47L 5/36* (2006.01)
*A47L 9/20* (2006.01)
*A47L 9/14* (2006.01)

(52) U.S. Cl.
CPC ..... *A47L 9/1463* (2013.01); *A47L 9/165* (2013.01); *A47L 9/1608* (2013.01); *A47L 9/1633* (2013.01); *A47L 9/1683* (2013.01); *A47L 9/20* (2013.01)

(58) Field of Classification Search
CPC ..... A47L 9/1691; A47L 9/127; A47L 9/12; A47L 9/1463; A47L 9/1633; A47L 9/165; A47L 9/20; A47L 5/26
See application file for complete search history.

(56) References Cited

U.S. PATENT DOCUMENTS

2003/0115713 A1* 6/2003 Yang ..... A47L 9/0081 15/327.2
2005/0198766 A1 9/2005 Nam et al.
2006/0101611 A1* 5/2006 Oh ..... A47L 9/1691 15/353
2008/0172992 A1* 7/2008 Conrad ..... A47L 5/36 55/323
2013/0091814 A1* 4/2013 Smith ..... A47L 9/1691 55/345
2017/0156559 A1* 6/2017 Krebs ..... A47L 9/1625
2019/0200827 A1* 7/2019 Crouch ..... A47L 9/322

FOREIGN PATENT DOCUMENTS

KR 10-2018-0053614 A 5/2018
KR 10-2019-0091842 A 8/2019
KR 10-2019-0127652 A 11/2019

OTHER PUBLICATIONS

Chinese Office Action and Search Report for Chinese Application No. 202080079630.6, dated Feb. 2, 2023, with English translation.

* cited by examiner

VACUUM CLEANER

CROSS-REFERENCE TO RELATED APPLICATION

Pursuant to 35 U.S.C. § 119(a), this application claims the benefit of an earlier filing date of and the right of priority to Korean Application No. 10-2019-0157469, filed on Nov. 29, 2019 in the Republic of Korea, the contents of which are incorporated by reference herein in their entirety.

FIELD

The present disclosure relates to a vacuum cleaner. More particularly, the present disclosure relates to a vacuum cleaner of which a body is easily separated so as to make it easy to clean the inside thereof.

BACKGROUND

A vacuum cleaner is a device that suctions foreign substances such as dust together with surrounding air, and separates and stores the foreign substances from the air.

Accordingly, the vacuum cleaner suctions air, and the suctioned air flows along a predetermined path. In the process of the air flowing along the predetermined path, foreign substances mixed with the air are separated therefrom. Accordingly, the vacuum cleaner has a motor-related component for generating a large suction force, air flow path and filter components for separating the foreign substances from the suctioned air, and a component for exhausting the filtered air.

As a body of the vacuum cleaner is miniaturized, parts of the vacuum cleaner for suctioning air, separating foreign substances in the suctioned air, and storing the foreign substances are complicatedly arranged in a small space. Accordingly, it is difficult to clean the inside of the body of the vacuum cleaner, and disassemble the vacuum cleaner.

As related art, Korean Patent Application Publication No. 10-2018-0053614 (hereinafter referred to as "related art 1") discloses a vacuum cleaner.

The vacuum cleaner disclosed in related art 1 includes a first cyclone and a second cyclone using a centrifugation method. The first cyclone and the second cyclone are accommodated in a body of the vacuum cleaner, and the body is provided with a suction motor and a dust container in addition to the first cyclone and the second cyclone. In related art 1, a part of the body of the vacuum cleaner is formed to be separable, thus allowing foreign substances stored in the body to be removed or the inside of the body to be cleaned. However, there are structures that are difficult to expose to the outside due to complicated arrangement in the body of components to filter the foreign substances from the air. Accordingly, there is a limitation in that the foreign substances that accumulate in the body cannot be thoroughly cleaned by simply removing a part of the body.

In addition, Korean Patent Application Publication No, 10-2019-0091842 (hereinafter referred to as "related art 2") also discloses a vacuum cleaner.

In the vacuum cleaner disclosed in related art 2, a part of a body as well as a dust separation module for separating foreign substances from air are separable from the body. Accordingly, the vacuum cleaner of related art 2 is an improvement in comparison to the vacuum cleaner disclosed in related art 1 in that the inside of the body can cleaned more efficiently. However, there is a shortcoming in that it is not easy for a user to clean a zone that requires cleaning, due to foreign substances present in the dust separation module.

The above-described background technology is technical information that the inventors hold for the derivation of the present disclosure or that the inventors acquired in the process of deriving the present disclosure. Thus, the above-described background technology may not necessarily be regarded as known technology disclosed to the general public prior to the filing of the present application.

SUMMARY

One aspect of the present disclosure is to address an issue associated with some related art in which although foreign substances continuously accumulate in a vacuum cleaner, there is a space in the vacuum cleaner that is difficult to clean.

Another aspect of the present disclosure is to address an issue associated with some related art in which it is difficult to disassemble parts that are complicatedly arranged in a vacuum cleaner.

Still another aspect of the present disclosure is to address an issue associated with some related art in which it is not easy to perform disassembly and assembly in a predetermined order when disassembling a body of a vacuum cleaner in which various parts are densely arranged.

Still another aspect of the present disclosure is to address an issue associated with some related art in which a long period of time is required to remove foreign substances collected in a vacuum cleaner.

Still another aspect of the present disclosure is to address an issue associated with some related art in which it is difficult to cleanly remove foreign substances collected in a vacuum cleaner.

The present disclosure is not limited to what has been described above, and other aspects not mentioned herein will be apparent from the following description to one of ordinary skill in the art to which the present disclosure pertains.

A vacuum cleaner according to an embodiment of the present disclosure may include a suction inlet, a body, a first cyclone, and a dust separation module. The dust separation module may include a filter unit and a second cyclone. The filter unit may be formed to be separable from the second cyclone, thereby allowing the inside of the body to be easily cleaned.

Processes of separating the dust separation module from the body, separating the filter unit of the dust separation module, and separating a storage unit from a cyclone base may be sequentially performed, thereby reducing trial and error in separating the components and enabling quick disassembly and coupling.

The body and the dust separation module may be separated from each other. In the dust separation module, the filter unit and the second cyclone may be separated from each other. In the second cyclone, the cyclone base and the storage unit may be separated from each other. Accordingly, the inside of the body can be conveniently and easily cleaned and kept clean.

Specifically, the vacuum cleaner according to an embodiment of the present disclosure may include the suction inlet, the body, the first cyclone, and the dust separation module. The dust separation module may include the filter unit and the second cyclone, and the filter unit may be separated from the second cyclone.

The body may include a suction motor and an exhaust module. The suction motor may allow air to flow in one direction. The exhaust module may be a passage through which air that is introduced into the suction inlet and passes through the suction motor is discharged to the outside of the body.

The dust separation module may be arranged before the suction motor on a flow path of the air that is introduced into the suction inlet, passes through the suction motor, and is discharged through the exhaust module.

In the second cyclone, the cyclone base and the storage unit may be rotatably coupled to each other. When the storage unit is rotated in one direction with respect to the cyclone base, the cyclone base and the storage unit may be separated from each other. When the filter unit is coupled to the second cyclone, the cyclone base and the storage unit may not be separated from each other.

In the dust separation module, the filter unit may include at least one rotation restraining protrusion. When the filter unit, the second cyclone, and the storage unit are coupled to one another, the rotation restraining protrusion may be accommodated in a rotation restraining groove formed in the storage unit.

The rotation restraining protrusion may include an inclined portion inclined in one direction, and a movement blocker formed perpendicular to a direction in which the cyclone base and the storage unit are mutually rotated for coupling to or separation from each other. The rotation restraining groove may include an inclined contact portion and a fastener. The inclined contact portion may contact the inclined portion when the cyclone base and the storage unit are rotated in a direction in which the cyclone base and the storage unit are separated from each other, and the fastener may contact the movement blocker when the cyclone base and the storage unit are rotated in a direction in which the cyclone base and the storage unit are coupled to each other.

When the cyclone base and the storage unit are rotated in a direction in which the cyclone base and the storage unit are separated from each other and when the inclined portion is in contact with the inclined contact portion, the filter unit may be separated from the second cyclone.

The second cyclone may include a grip portion protruding upward on an upper surface thereof.

The body may include a first storage and a body cover. The first storage may be provided in the body to accommodate foreign substances collected by the first cyclone. The body cover may be formed on a lower portion of the first storage to open and close the first storage.

A second storage may be formed in the storage unit to collect foreign substances, and the body cover may open and close the first storage and second storage together.

In the dust separation module, the second cyclone and the storage unit may be rotatably coupled to each other via a hinge coupling portion, and the rotation restraining protrusion formed in the filter unit may be accommodated in the rotation restraining groove formed in the storage unit to couple the second cyclone and the storage unit to each other.

The filter unit may include a main filter and a filter frame. At least one rotation restraining protrusion may be formed on the filter frame.

The second cyclone and the storage unit may be separated from each other by being mutually rotated with respect to the hinge coupling portion in a state in which the rotation restraining protrusion of the filter unit is separated from the rotation restraining groove.

A vacuum cleaner according to another embodiment of the present disclosure may include a suction inlet, a body, a first cyclone, and a dust separation module. The dust separation module may include a filter unit, a second cyclone, and a storage unit. The separation module may be formed to be separable from the body. The filter unit, the second cyclone, and the storage unit may be separated from one another in a state in which the dust separation module is separated from the body.

According to the present disclosure, not only can the dust separation module be separated from the body, but the filter unit and the storage unit forming the dust separation module can also be separated from each other to expose the inside of the body to the outside, thereby making it easy to clean the inside.

According to the present disclosure, the body and the dust separation module are provided to be separated from and coupled to each other through only a simple operation, and thus there is an effect of enabling quick and easy separation or coupling.

According to the present disclosure, based on an order of separating the body and the dust separation module from each other, when separation at a previous step is not performed, separation at a subsequent step cannot be performed, and thus there is an effect of reducing a user's trial and error when separating and coupling the body and dust separation module from and to each other.

According to the present disclosure, there is an advantage in that separation and coupling of the filter unit, the second cyclone, and the storage unit of the dust separation module can be quickly performed.

According to the present disclosure, the filter unit, the second cyclone, and the storage unit of the dust separation module can be separated from one another, thus enabling the user to clean the inside of the dust separation module.

The effects of the present disclosure are not limited to those mentioned above, and other effects not mentioned can be clearly understood by those skilled in the art from the following description.

BRIEF DESCRIPTION OF THE DRAWINGS

The foregoing and other aspects, features, and advantages of the invention, as well as the following detailed description of the embodiments, will be better understood when read in conjunction with the accompanying drawings. For the purpose of illustrating the present disclosure, there is shown in the drawings an exemplary embodiment, it being understood, however, that the present disclosure is not intended to be limited to the details shown because various modifications and structural changes may be made therein without departing from the spirit of the present disclosure and within the scope and range of equivalents of the claims. The use of the same reference numerals or symbols in different drawings indicates similar or identical items.

DETAILED DESCRIPTION

Figure 1:
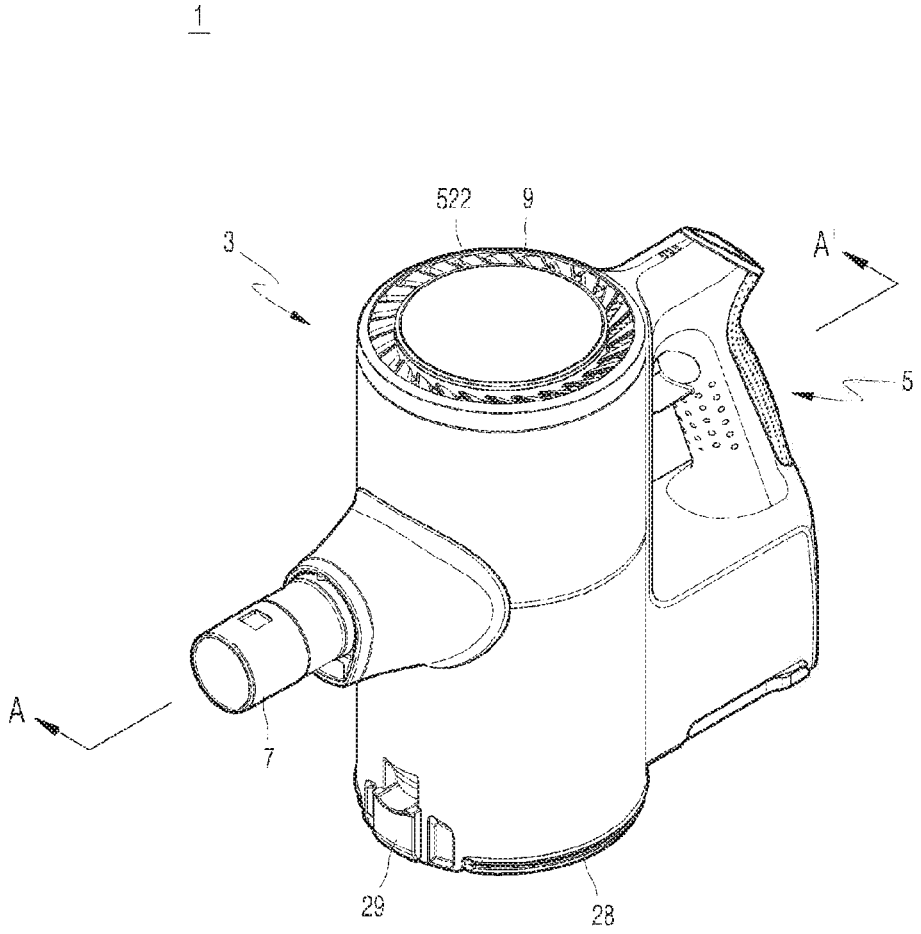
FIG. 1 is a perspective view of a vacuum cleaner according to an embodiment of the present disclosure.

Hereinafter, embodiments disclosed for the purpose of description will be described in more detail with reference to the accompanying drawings. The same reference numerals are used to designate the same components throughout the detailed description.

FIG. 1 is a perspective view of a vacuum cleaner 1 according to an embodiment of the present disclosure.

As illustrated in FIG. 1, the vacuum cleaner 1 according to an embodiment of the present disclosure may include a body 3, a handle portion 5, a suction inlet 7, and an exhaust module 9.

A series of paths through which air flows may be formed in the inside of the body 3. A suction inlet 7 through which air is introduced into the body 3 may be formed on one side of the body 3. Further, the handle portion 5 may be provided on an opposite side of the suction inlet 7. In addition, the exhaust module 9 may include an exhaust port 522 coupled to an upper portion of the body 3 to discharge air introduced from the suction inlet 7 to the outside of the body 3 through the body 3.

Figure 2:
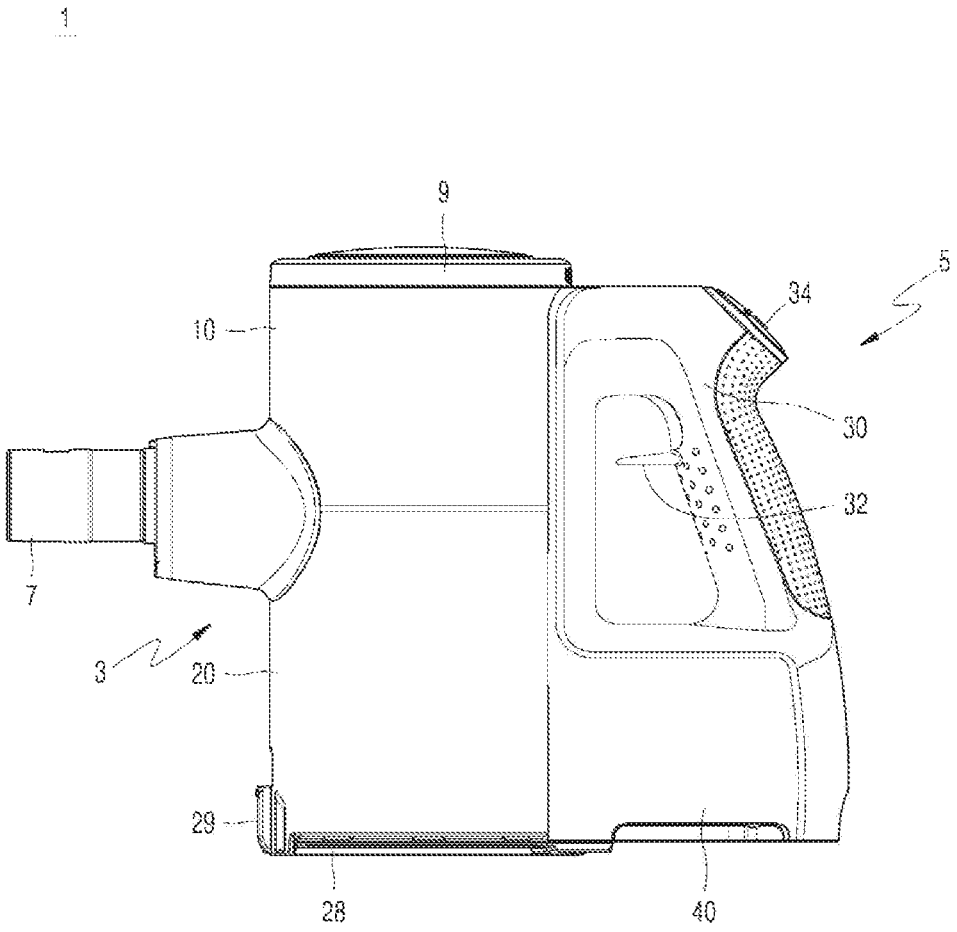
FIG. 2 is a front view of a vacuum cleaner according to an embodiment of the present disclosure.
Figure 3:
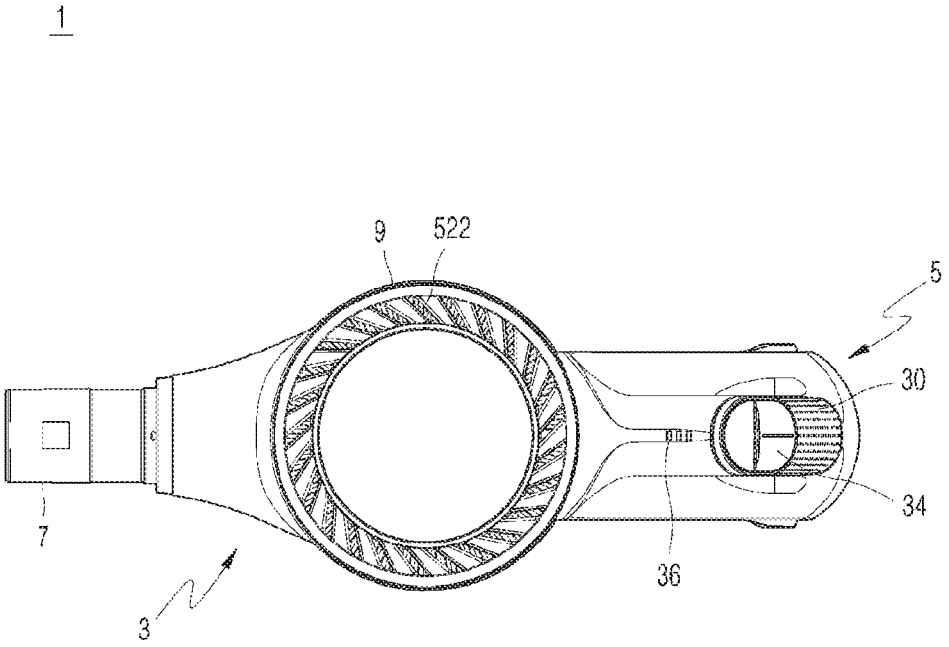
FIG. 3 is a plan view of a vacuum cleaner according to an embodiment of the present disclosure.
Figure 4:
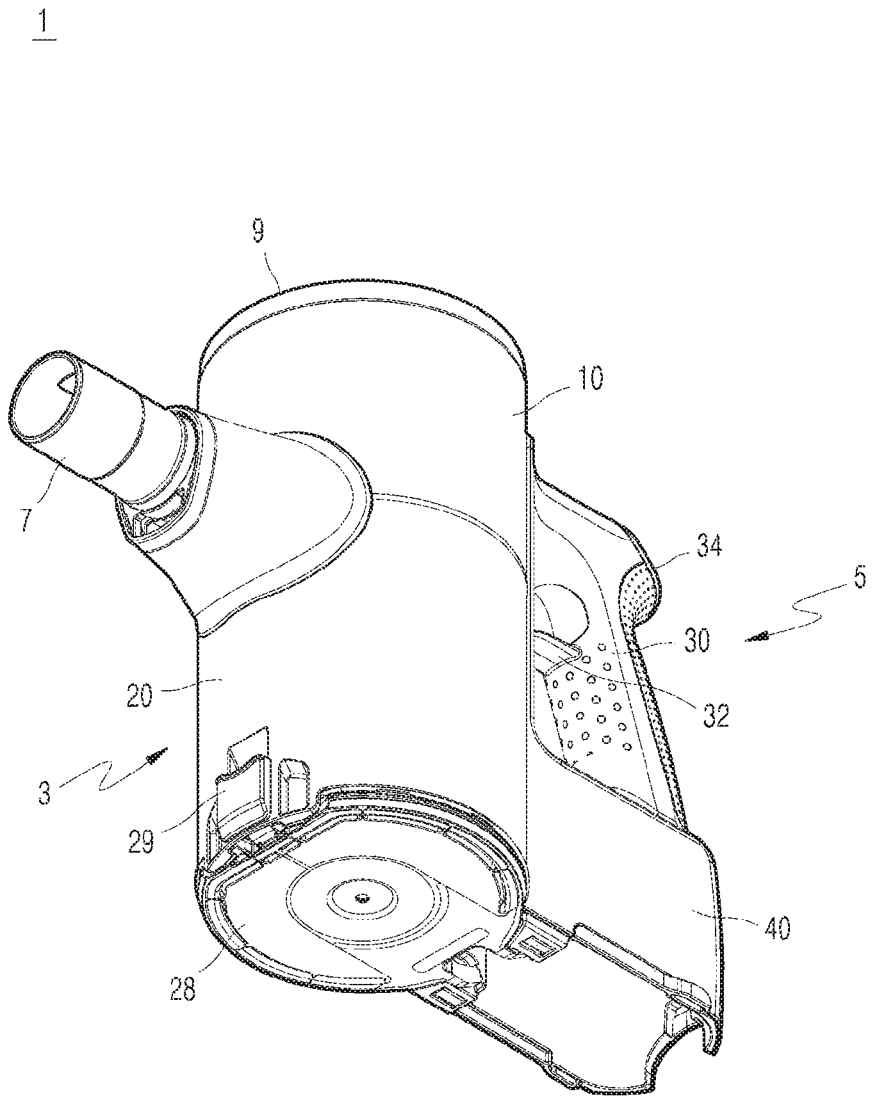
FIG. 4 is a bottom perspective view of a vacuum cleaner according to an embodiment of the present disclosure.

FIG. 2 is a front view of the vacuum cleaner 1 according to an embodiment of the present disclosure. FIG. 3 is a plan view of the vacuum cleaner 1 according to an embodiment of the present disclosure. FIG. 4 is a bottom perspective view of the vacuum cleaner 1 according to an embodiment of the present disclosure.

As illustrated in FIGS. 2 to 4, in the vacuum cleaner 1 according to an embodiment of the present disclosure, the body 3 may include a first body 10 and a second body 20. In the body 3 composed of the first body 10 and the second body 20, a predetermined space may also be formed. The body 3 may include a first space that is an inner space of the first body 10 and a second space that is an inner space of the second body 20. Such dividing of the inner space of the body 3 into the first space and the second space is for the purpose of describing an embodiment of the present disclosure, and the inner space of the body 3 is not divided in a functional manner. However, the first space is positioned above the second space, and the second space is positioned below the first space. Accordingly, air introduced through the suction inlet 7 may move to the first space through the second space.

The suction inlet 7 may be provided on one side of the body 3, and may be open in a direction away from the body 3. The suction inlet 7 may be coupled to an accessory for suctioning and cleaning. The suction inlet 7 may suction air from an open end thereof or the accessory for suctioning and cleaning coupled to the suction inlet 7, and an extension part coupled to the suction inlet 7 may be provided with components for assisting cleaning at an end thereof. The suction inlet 7 may guide the suctioned air into the body 3. The handle portion 5 may be formed on an opposite side of the body 3 relative to suction inlet 7. The handle portion 5 may include a handle 30, a movement limiter 32, an operation interface 34, and a display 36. The handle 30 may have a grip shape such that a user can grip the handle 30. The movement limiter 32 may be provided in the handle 30 to restrain the user's finger or body part so that the user's hand gripping the handle 30 does not slip. The operation interface 34 may be provided in the handle 30, and may be formed to allow the user to enter a predetermined command while holding the handle 30. The display 36 may be provided on an upper portion of the handle 30, and may display information related to an operating state of the vacuum cleaner 1 for the user.

The exhaust module 9 may be coupled to the upper portion of the body 3. The exhaust module 9 may form an upper surface of the body 3, and may be a passage through which air introduced into the body 3 through the suction inlet 7 is discharged to the outside of the body 3. The exhaust module 9 may include a plurality of exhaust ports 522 through which air is discharged to the outside of the body 3. The exhaust ports 522 may be open toward an upper direction of the body 3 with respect to the body 3.

Figure 5:
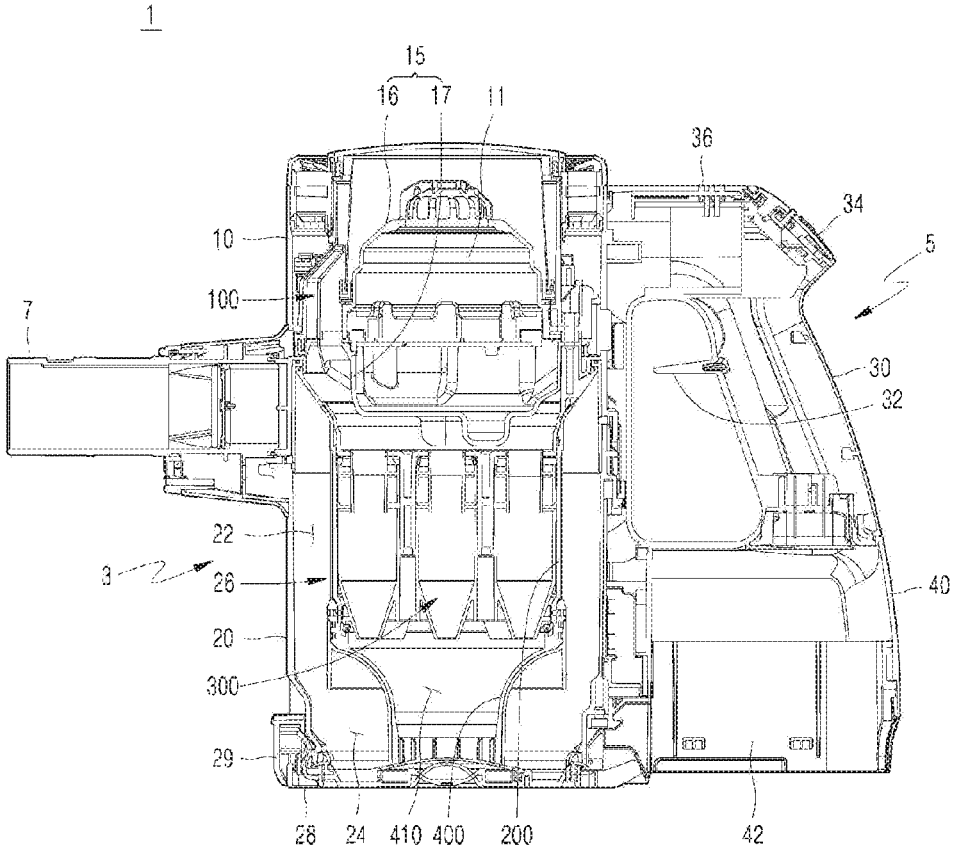
FIG. 5 is a cross-sectional view taken along line A-A' of FIG. 1.

FIG. 5 is a cross-sectional view taken along line A-A' of FIG. 1.

As illustrated in FIG. 5, the body 3 of the vacuum cleaner 1 according to an embodiment of the present disclosure may include a suction motor 11, a motor housing 15, a flow guide 100, and a dust separation module 26.

Air suctioned through the suction inlet 7 may be guided to the second space. The second space may include a first cyclone 22 that filters foreign substances from the air introduced through the suction inlet 7, and a first storage 24 in which the foreign substances filtered by the first cyclone 22 fall and are collected. The dust separation module 26 may be arranged in the second space, and the dust separation module 26 may suction air from the first cyclone 22, and may filter foreign substances through the filter unit 200.

Accordingly, the air introduced into the suction inlet 7 may move to the first cyclone 22. In the first cyclone 22, the foreign substances may be first filtered by the filter unit 200, and then may fall to the first storage 24. Air passing through the filter unit 200 and introduced into the dust separation module 26 may be introduced into the second cyclone 300.

The second cyclone 300 may include a cyclone array 320 (see FIG. 10), a cyclone base 330 (see FIG. 10), and a storage unit 400.

The filter unit 200 may surround an outer circumference of the second cyclone 300. The filter unit 200 may include a filter frame 210 (see FIG. 8) and a main filter 220 (see FIG. 8). The main filter 220 may be coupled to the filter frame 210, and thus an outer shape thereof may be formed. Further, the main filter 220 may be formed of a surface provided with a plurality of holes of a predetermined size. Alternatively, the main filter 220 may be in the form of a mesh. The filter unit 200 may be formed in a hollow cylindrical shape, and may be fitted to the second cyclone 300 by sliding in a longitudinal direction of the cylindrical shape.

Figure 10:
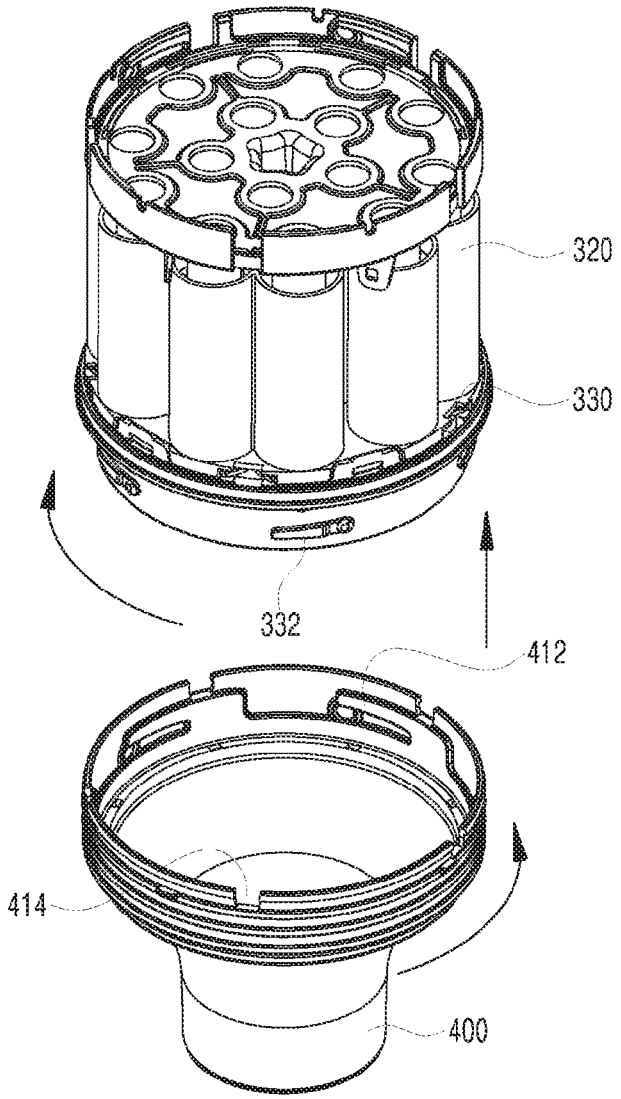
FIG. 10 is a perspective view illustrating a state in which a second cyclone and a storage unit are separated from each other in a dust separation module of a vacuum cleaner according to an embodiment of the present disclosure.

The second cyclone 300 may include the cyclone array 320 (see FIG. 10) and the cyclone base 330 (see FIG. 10). The cyclone array 320 may be composed of a plurality of cyclone cones. The cyclone cones may each be rotatably coupled to the cyclone base 330. The cyclone cones each may have a diameter that becomes gradually smaller downward. The cyclone base 330 may be rotatable with respect to the center thereof, and the plurality of cyclone cones coupled to the cyclone base 330 may each be rotatable with respect to the cyclone base 330. Accordingly, through the rotation of the cyclone base 330 and the cyclone cones, foreign substances contained in air may fall and be pushed to the edge of the dust separation module 26 by centrifugal force.

Each cyclone cone may have a wide upper portion and a narrow lower portion, and a lowermost end of each cyclone cone may have a narrow passage. Such shapes of the cyclone cones of the second cyclone 300 may prevent the foreign substances pushed out by centrifugal force after falling from being introduced back into the cyclone array 320.

Specifically, the foreign substances separated by the first cyclone 22 may be collected in the first storage 24, and the foreign substances separated from the second cyclone 300 may be stored in a second storage 410 that is an inner space of the storage unit 400.

The air that is introduced into the suction inlet 7 and passes through the first cyclone 22 and the second cyclone 300 may move to the suction motor 11 along a space formed between the flow guide 100 and the motor housing 15. The suction motor 11 may be mounted in the motor housing 15. The suction motor 11 may allow surrounding air to flow in at least one direction.

The suction motor 11 may be a brushless DC (BLDC) electric motor, which generates relatively little noise and has a long lifespan. Alternatively, the suction motor 11 may be an inverter motor capable of variably changing the speed of a motor. The suction motor 11 may be mounted in the motor housing 15 to allow air to flow in at least one direction along an air flow path formed by the motor housing 15. In the vacuum cleaner 1 according to an embodiment of the present disclosure, a suction force may be generated through the suction motor 11.

The motor housing 15 may include an upper motor housing 16 and a lower motor housing 17. The upper motor housing 16 and the lower motor housing 17 may be coupled to each other to form the motor housing 15. The suction motor 11 may be coupled to the inside of the motor housing 15, and the motor housing 15 may guide air flowing through the suction motor 11 to move along a series of paths.

The flow guide 100 may be coupled to the outside of the motor housing 15. The flow guide 100 may form a predetermined space between an outer surface of the motor housing 15 and the flow guide 100. The space formed between the flow guide 100 and the motor housing 15 may be used as a passage through which air flows.

The motor housing 15 and the flow guide 100 may be arranged in the first space, and the dust separation module 26 may be arranged in the second space.

That is, the suction force generated through the suction motor 11 may introduce air into the suction inlet 7, and the introduced air may pass through the first cyclone 22, the second cyclone 300, the flow guide 100, the inner space of the motor housing 15, and the suction motor 11. The air passing through the suction motor 11 may move to the exhaust module 9 through a space formed between an outer surface of the flow guide 100 and an inner surface of the first body 10. The air moved to the exhaust module 9 may be discharged to the outside of the body 3 through the exhaust ports 522.

Here, a body cover 28 may be provided on a lower surface of the second body. One side of the body cover 28 may be rotatably coupled to the body 3, and the body cover 28 that forms the lower surface of the second body 20 may be opened or closed by the operation of an opening and closing button 29. When the body cover 28 is closed, the first storage 24 and the second storage 410 may be isolated from the outside. Accordingly, foreign substances stored in the first storage 24 and the second storage 410 may continuously accumulate. When the body cover 28 is opened, the first storage 24 and the second storage 410 may be opened toward a lower direction of the body 3. Accordingly, when the body cover 28 is opened, the foreign substances stored in the first storage 24 and the second storage 410 may be drawn out of the body 3.

In addition, the handle portion 5 may include the handle 30, the movement limiter 32, the operation interface 34, the display 36, and a battery housing 40. The battery housing 40 is formed on a lower portion of the handle 30, and a battery 42 may be mounted in an inner space of thereof. The battery 42 may be coupled to the inside of the battery housing 40, and may be provided to be replaceable. The battery 42 may be relatively heavy in weight. Thus, when the battery 42 is positioned at the lower portion of the handle 30, the user can easily grip the handle 30 and operate the vacuum cleaner 1 according to an embodiment of the present disclosure.

Figure 6:
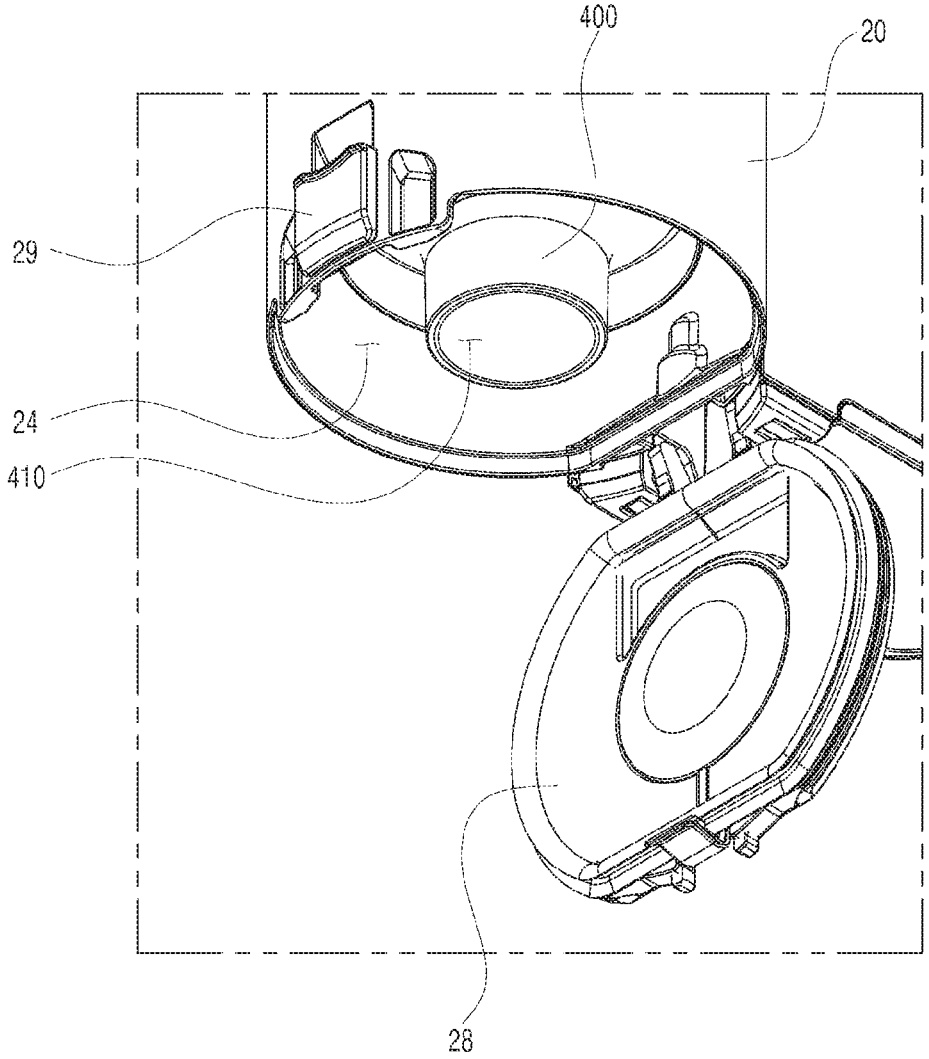
FIG. 6 is a partial perspective view illustrating a body cover of a vacuum cleaner according to an embodiment of the present disclosure.

FIG. 6 is a partial perspective view illustrating the body cover 28 of the vacuum cleaner 1 according to an embodiment of the present disclosure.

As illustrated in FIG. 6, the body cover 28 may form the lower surface of the second body 20, and may be opened or closed through the operation of the opening and closing button 29.

Accordingly, the lower surface of the second body 20 may be opened downward when the body cover 28 is opened. As described above, when the body cover 28 is opened, the first storage 24, which is a space between an inner surface of the second body 20 and an outer surface of the storage unit 400, may be opened downward. The second storage 410, which is an inner space of the storage unit 400, may be also opened downward. As a result, foreign substances collected in the first storage 24 and the second storage 410 may be drawn out in a downward direction of the second body 20 when the body cover 28 is opened.

Figure 7:
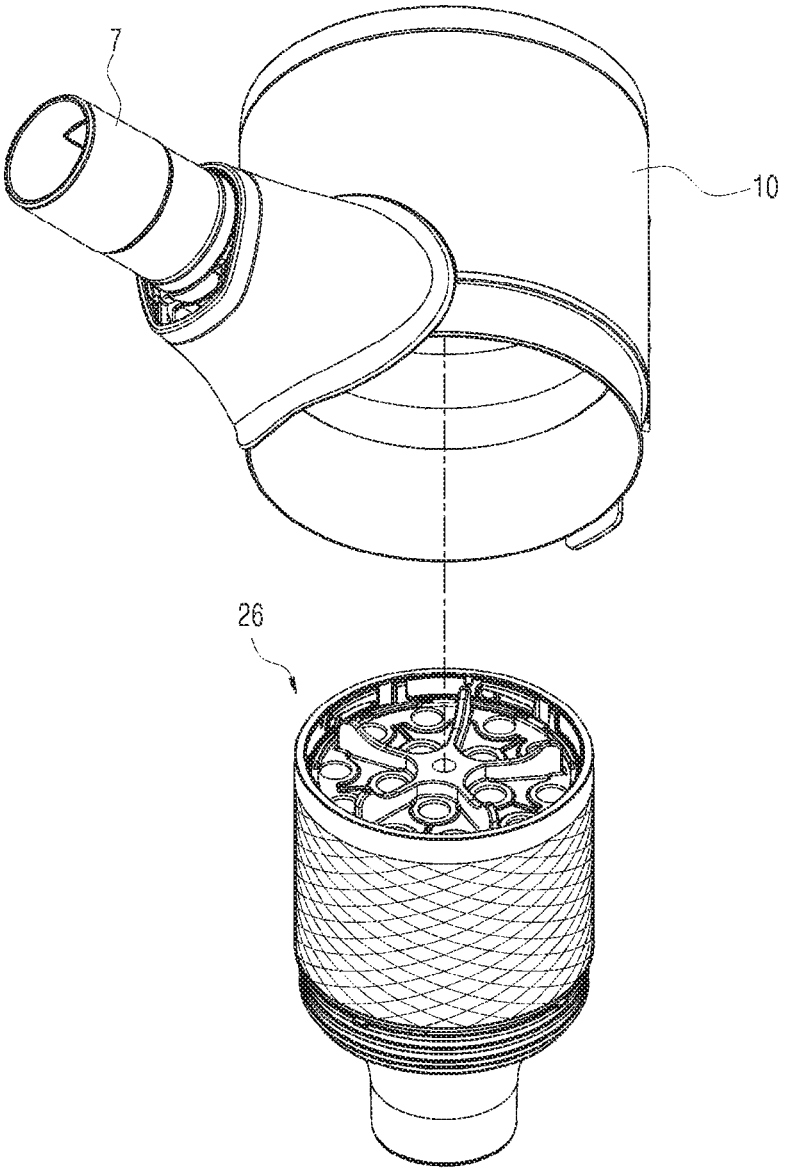
FIG. 7 is a view illustrating a state in which a dust separation module is separated from a first body of a vacuum cleaner according to an embodiment of the present disclosure.
Figure 8:
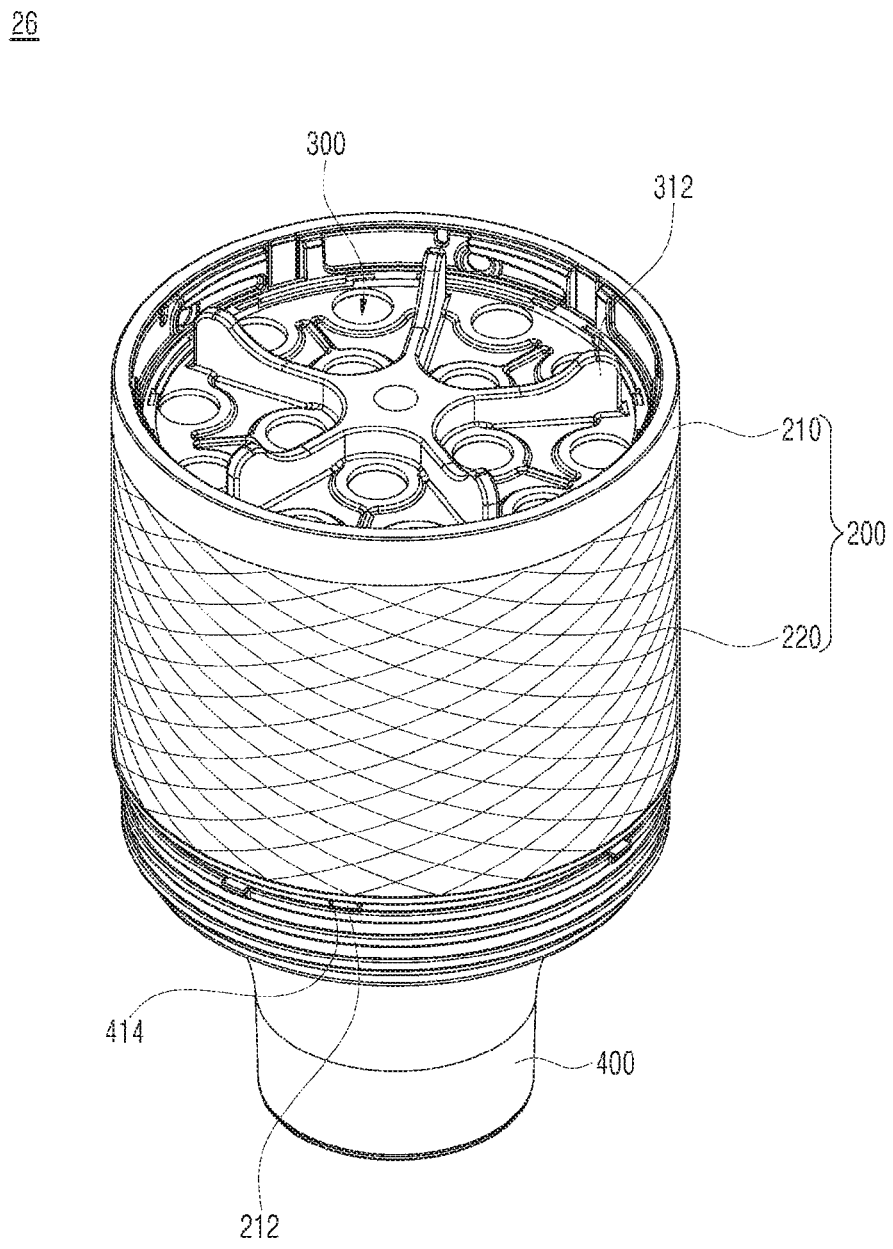
FIG. 8 is a perspective view illustrating a dust separation module of a vacuum cleaner according to an embodiment of the present disclosure.
Figure 9:
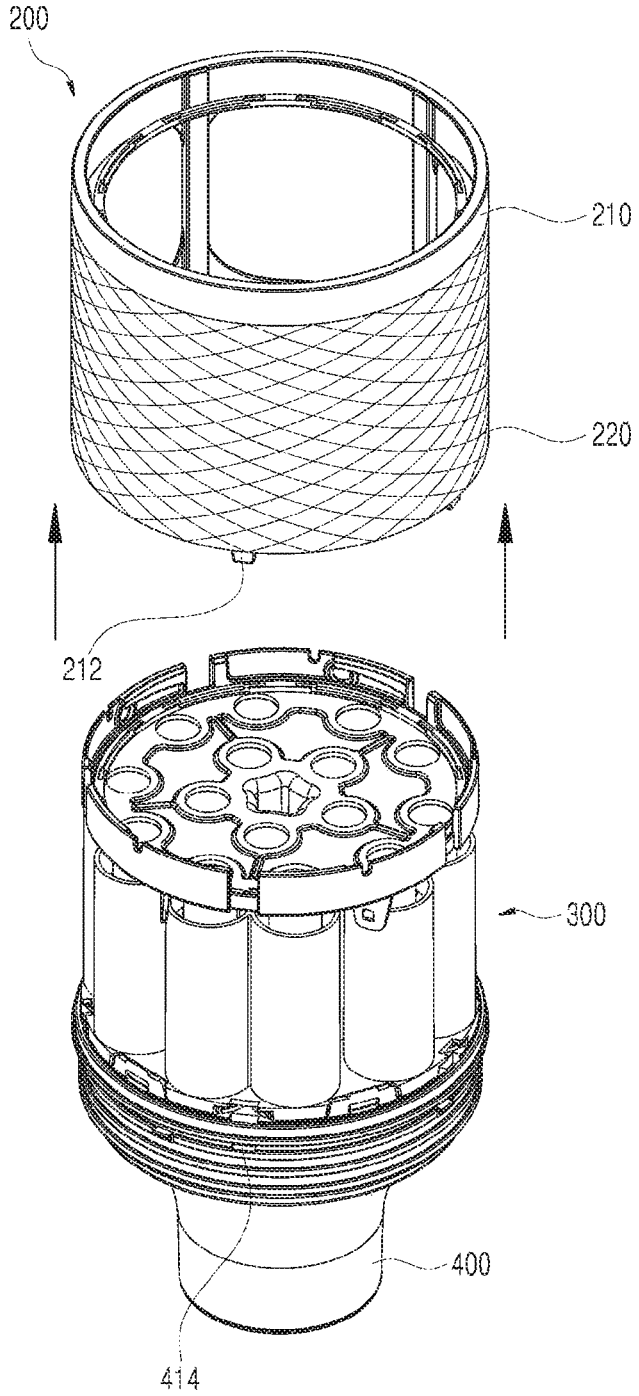
FIG. 9 is a perspective view illustrating a state in which a filter unit is separated from a dust separation module of a vacuum cleaner according to an embodiment of the present disclosure.

FIG. 7 is a view illustrating a state in which the dust separation module 26 is separated from the first body 10 of the vacuum cleaner 1 according to an embodiment of the present disclosure, FIG. 8 is a perspective view illustrating the dust separation module 26 of the vacuum cleaner 1 according to an embodiment of the present disclosure. FIG. 9 is a perspective view illustrating a state in which the filter unit 200 is separated from the dust separation module 26 of the vacuum cleaner 1 according to an embodiment of the present disclosure. FIG. 10 is a perspective view illustrating a state in which the second cyclone 300 and the storage unit 400 are separated from each other in the dust separation module 26 of the vacuum cleaner 1 according to an embodiment of the present disclosure.

With reference to FIGS. 7 to 10, in the vacuum cleaner 1 according to an embodiment of the present disclosure, the second body 20 may be separated from the first body 10. When the second body 20 is separated from the first body 10, the dust separation module 26 may be exposed to the outside while an upper end thereof is coupled to the first body 10.

The upper end of the dust separation module 26 may be coupled to a lower portion of the flow guide 100 or a lower end of the motor housing 15, forming a path through which air moving to an upper portion of the dust separation module 26 through the dust separation module 26 can flow into a space formed by the flow guide 100 and the motor housing 15.

The dust separation module 26 may be separated from the first body 10 by a user rotating the dust separation module 26 in one direction. Here, when the user grips and rotates the storage unit 400, the storage unit 400 may be rotated and become separated from the cyclone base 330. In order to prevent such separation, the dust separation module 26 may include a rotation restraining protrusion 212 and a rotation restraining groove 414. The rotation restraining protrusion 212 may be formed in the filter frame 210. The rotation restraining protrusion 212 may be formed to protrude downward from the filter frame 210. In addition, the rotation restraining groove 414 may be formed on an outer circumference of the storage unit 400, and may have a shape, size, and position corresponding to those of the rotation restraining protrusion 212 so as to accommodate the rotation restraining protrusion 212 therein. The filter unit 200 may be separated from the second cyclone 300 when the dust separation module 26 is separated from the first body 10. The filter unit 200 may be separated by sliding an upper portion of the second cyclone 300 along the longitudinal direction of the cylindrical shape. Here, the rotation restraining protrusion 212 may be separated from the rotation restraining groove 414 as the filter unit 200 is removed.

When the rotation restraining protrusion 212 is accommodated in the rotation restraining groove 414, that is, a state in which the filter unit 200 is coupled to the second cyclone 300, the cyclone base 330 and the storage unit 400 of the second cyclone 300 cannot be mutually rotated. Accordingly, the storage unit 400 does not become separated from the cyclone base 330.

On the cyclone base 330, a coupling protrusion 332 protruding outward on an outer circumference thereof may be formed. In addition, a coupling groove 412 in which the coupling protrusion 332 is accommodated may be formed on an inner surface of the storage unit 400 in contact with the cyclone base 330. The coupling protrusion 332 and the coupling groove 412 may he coupled to or separated from each other as the coupling protrusion 332 and the coupling groove 412 move laterally. Accordingly, when the storage unit 400 is rotated along the outer circumference of the cyclone base 330, the storage unit 400 may be coupled to or separated from the cyclone base 330 according to a rotation direction of the storage unit 400.

Figure 11:
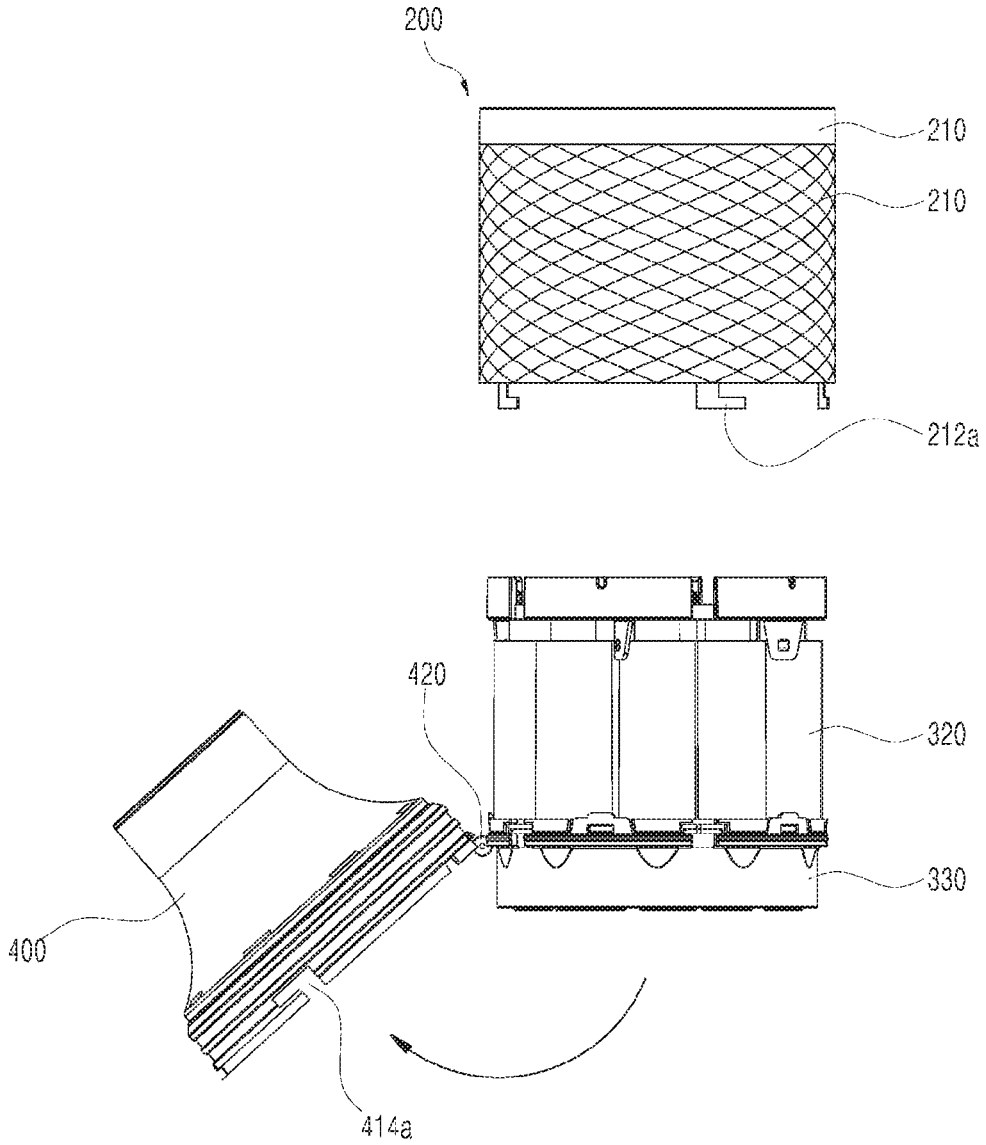
FIG. 11 is a view illustrating a state in which a second cyclone and a storage unit are coupled via a hinge coupling portion in a dust separation module of a vacuum cleaner according to an embodiment of the present disclosure.

FIG. 11 is a view illustrating a state in which the cyclone base 330 and the storage unit 400 are coupled via a hinge coupling portion 420 in the dust separation module 26 of the vacuum cleaner 1 according to an embodiment of the present disclosure.

As illustrated in FIG. 11, in the dust separation module 26 according to an embodiment of the present disclosure, a rotation restraining protrusion 212*a* and a rotation restraining groove 414*a* may interfere to prevent the filter unit 200 from being separated from the second. cyclone 300. Here, the rotation restraining protrusion 212*a* may be formed in the filter frame 210, and the rotation restraining groove 414*a* may be formed in the storage unit 400. The rotation restraining protrusion 212*a* may protrude toward a lower portion of the filter frame 210, and an end of the rotation restraining protrusion 212*a* may extend sideward by a predetermined length. The rotation restraining groove 414*a* may be elongated sideward so as to accommodate the end of the rotation restraining protrusion 212*a* therein. Accordingly, in order to separate the rotation restraining protrusion 212*a* from the rotation restraining groove 414*a*, it is required to rotate the filter unit 200 by a predetermined length in a circumferential direction thereof. Such a configuration functions to fasten the storage unit 400 to the rotation restraining protrusion 212*a* when the filter unit 200 is coupled to the second cyclone 300. The storage unit 400 may be rotatably coupled to the cyclone base 330 via the hinge coupling portion 420. When the filter unit 200 is removed from the cyclone base 330, the rotation restraining protrusion 212*a* and the rotation restraining groove 414*a* are separated from each other, so that the storage unit 400 that has been coupled to the lower end of the cyclone base 330 can be opened.

Accordingly, when the filter unit 200 is removed from the second cyclone 300, at least a part of the storage unit 400 may be separated from the cyclone base 330. Through such a configuration, the inner surface of the storage unit 400 also may be exposed to the outside, thereby allowing the user to clean the inner surface of the storage unit 400.

Figure 12:
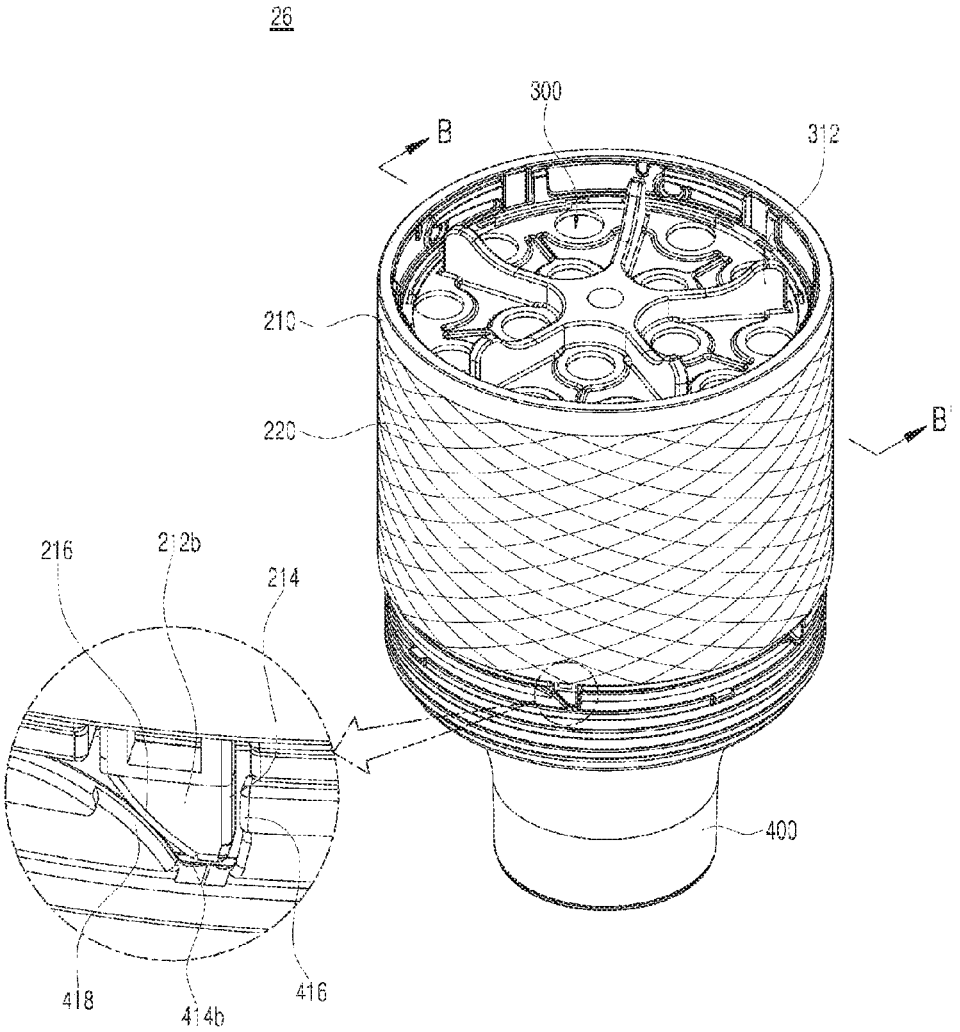
FIG. 12 is a view illustrating a rotation restraining protrusion and a rotation restraining groove in a dust separation module of a vacuum cleaner according to an embodiment of the present disclosure.
Figure 13:
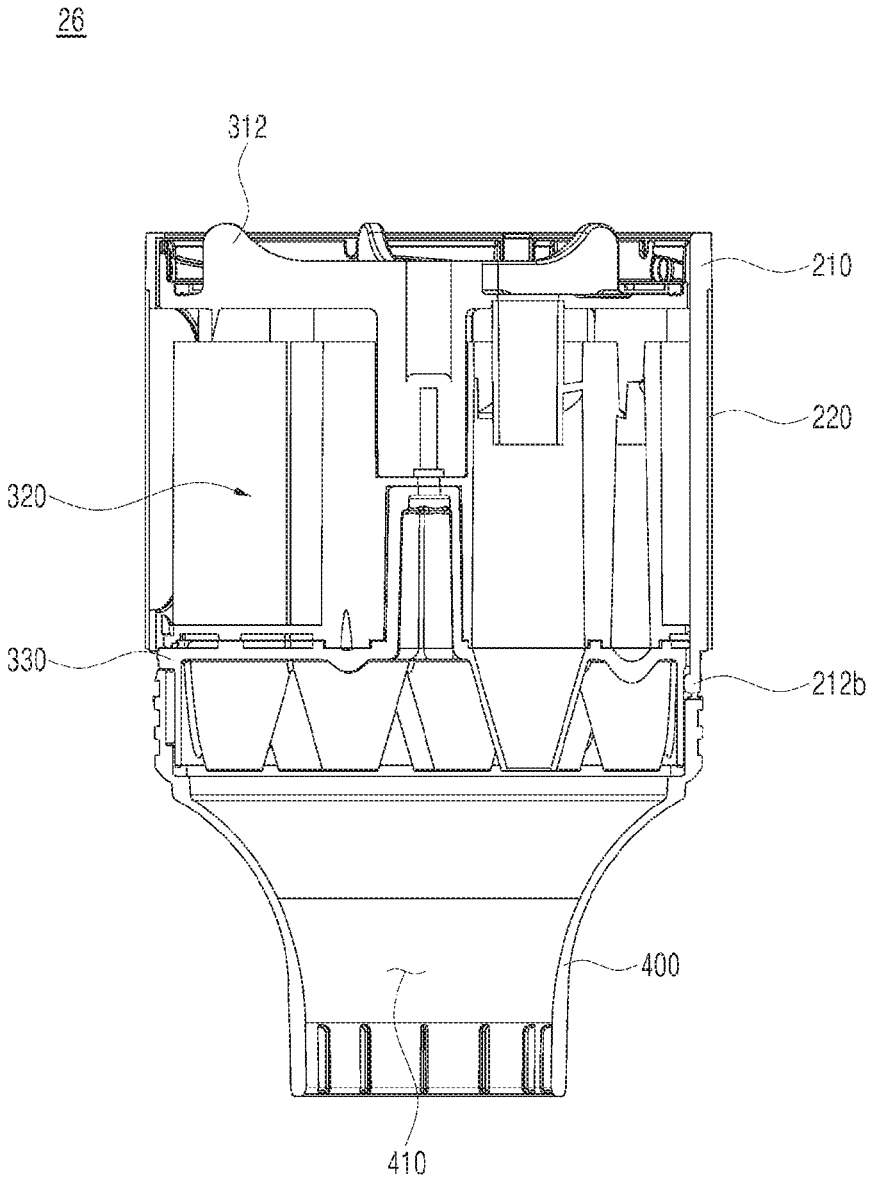
FIG. 13 is a cross-sectional view taken along line B-B' of FIG. 12.

FIG. 12 is a view illustrating the rotation restraining protrusion 212*b* and the rotation restraining groove 414*b* in the dust separation module 26 of the vacuum cleaner 1 according to an embodiment of the present disclosure. FIG. 13 is a cross-sectional view taken along line B-B' of FIG. 12.

As illustrated in FIG. 12, the rotation restraining protrusion 212*b* and the rotation restraining groove 414*b* may be formed at an incline on one side of the dust separation module On one side of the rotation restraining protrusion 212*b*, a movement blocker 214 that is perpendicular to a direction in which the storage unit 400 is rotated with respect to the cyclone base 330 may be formed. On the other side of the rotation restraining protrusion 212*b* opposite to the movement blocker 214, an inclined portion 216 that is inclined in one direction may be formed.

The rotation restraining groove 414*b* may have a shape corresponding to that of rotation restraining protrusion 212*b*, and a fastener 416 may be formed at a position corresponding to that of the movement blocker 214, and an inclined contact portion 418 may be formed at a position corresponding to that of the inclined portion 216. In addition, an upper surface of the second cyclone 300 may be provided with a grip portion 312 protruding upward. The grip portion 312, which is a member formed to protrude so as to be gripped by a hand of the user, may be provided such that the filter unit 200 can easily be rotated in one direction.

Accordingly, when the filter unit 200 is rotated with respect to the second cyclone 300 to bring the movement blocker 214 and the fastener 416 into contact with each other, the filter unit 200 and the second cyclone 300 are no longer rotated. However, when the filter unit 200 is rotated in an opposite direction, the inclined portion 216 and the inclined contact portion 418 may be in contact with each other. The inclined portion 216 and the inclined contact portion 418 each may have a surface inclined in one direction, and thus a force may be applied in a direction in which the filter unit 200 and the second cyclone 300 are away from each other. Here, an end of the rotation restraining protrusion 212*b* may be opened in a direction away from the second cyclone 300, and the filter unit 200 and the second cyclone 300 can be easily separated from each other.

Figure 14:
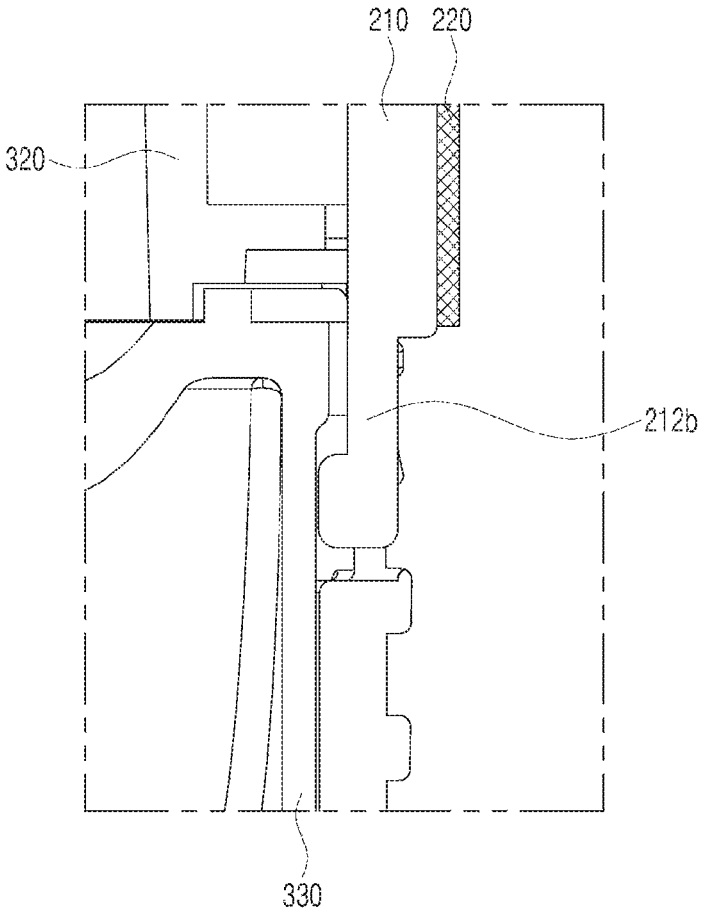
FIG. 14 is a partial cross-sectional view illustrating a cross-section of a rotation restraining protrusion in a vacuum cleaner according to an embodiment of the present disclosure.

FIG. 14 is a partial cross-sectional view illustrating a cross-section of the rotation restraining protrusion 212 in the vacuum cleaner 1 according to an embodiment of the present disclosure.

As illustrated in FIG. 14, the end of the rotation restraining protrusion 212*b* may be formed to partially protrude inward. The end of the rotation restraining protrusion 212*b* may be brought into engagement with the second cyclone 300, so that the filter unit 200 and the second cyclone may be coupled to each other. Here, when an inclined surface of the rotation restraining protrusion 212*b* and an inclined surface of the rotation restraining groove 414*b* are in contact with each other and accordingly a force is applied in a direction in which the rotation restraining protrusion 212*b* and the rotation restraining groove 414*b* are away from each other, the filter unit 200 and the second cyclone 300 may be automatically disassembled.

The operation of the cleaner 1 according to an embodiment of the present disclosure will now be described.

Figure 15:
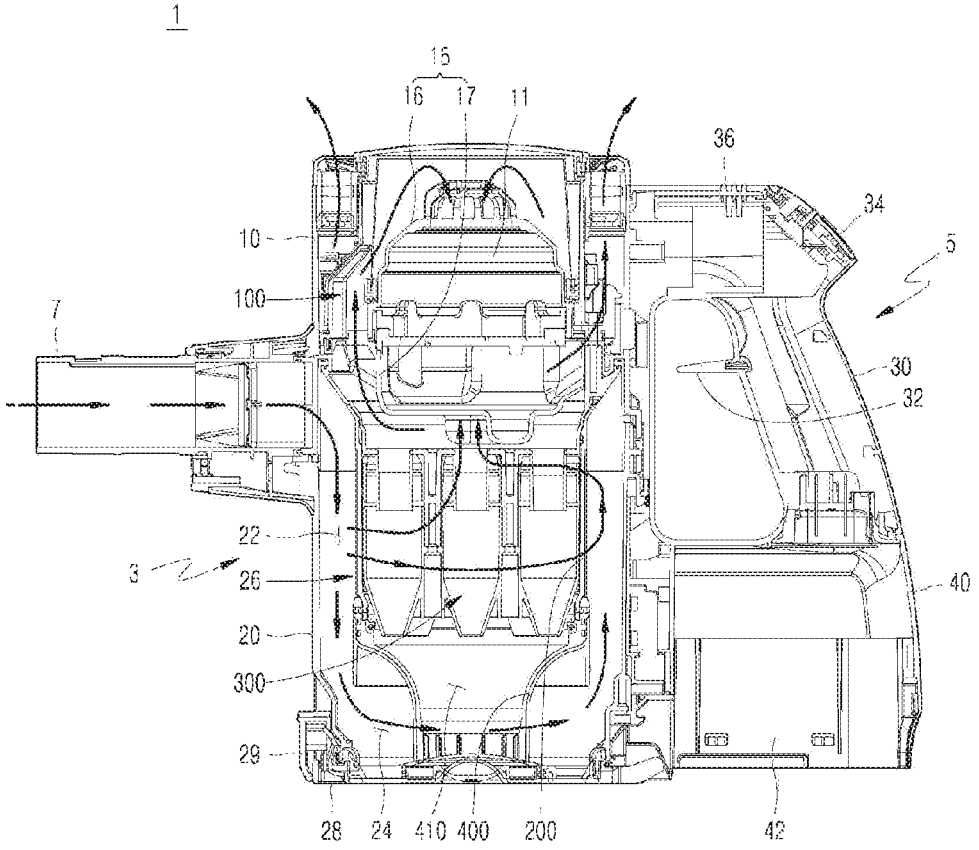
FIG. 15 is a schematic view illustrating a flow of air flowing into a body in a vacuum cleaner according to an embodiment of the present disclosure as a cross-sectional view taken along line A-A' of FIG. 1.

FIG. 15 is a schematic view illustrating a flow of air flowing into the body 3 in the vacuum cleaner 1 according to an embodiment of the present disclosure, as a cross-sectional view taken along line A-A' of FIG. 1.

As illustrated in FIG. 15, when the suction motor 11 operates, external air may be introduced through the suction inlet 7 provided on one side of the body 3. Here, an air suctioning force may suction not only air but also foreign substances such as surrounding dust and trash. In the first cyclone 22, the air suctioned into the suction inlet 7 may be separated from the foreign substances by a main filter 220. Here, the foreign substances separated from the air may be collected in the first storage 24. The air passing through the main filter 220 may move to the second cyclone 300, and the second cyclone 300 may separate foreign substances from the air again. The foreign substances separated by the second cyclone 300 may be collected in the second storage 410 that is an inner space of the storage unit 400.

The air passing through the second cyclone 300 may pass through the suction motor 11 through a flow path formed by the flow guide 100 and the motor housing 15, and the air passing through the suction motor may be discharged to the outside of the body 3 through the exhaust module 9.

The user can open the body cover 28 formed on the lower surface of the second body 20 to clean the foreign substances collected in the first storage 24 and the second storage 410. In addition, only the dust separation module 26 may be separated from the body 3 when the second body 20 is separated from the first body 10.

The filter unit 200 may be sequentially removed from the separated dust separation module 26, and the cyclone base 330 and the storage unit 400 each may be separated from the second cyclone 300. The separated storage unit 400 may be reassembled after the inner surface thereof is cleaned.

The present disclosure has been described with reference to the illustrated drawings, but the present disclosure is not limited to the disclosed embodiments and the drawings. It should be obvious to those skilled in the art that various modifications may be made within the scope of the present disclosure. In addition, even though operational effects according to a configuration of the present disclosure have not been explicitly described while describing the embodiments of the present disclosure, it should be appreciated that effects predictable from the configuration can also obtained.

What is claimed is:

1. A vacuum cleaner comprising:

a body including a space configured to allow air to flow therethrough;

a suction inlet configured to introduce the air into the body;

a first cyclone provided in the body and configured to separate foreign substances from the air introduced through the suction inlet; and a dust separation module, comprising:

a filter unit configured to separate foreign substances from the air received from the first cyclone; and a second cyclone arranged within and separated from the filter unit, the second cyclone comprising:

a cyclone base;

a storage unit arranged adjacent to a lower portion of the second cyclone; and a cyclone array coupled to the cyclone base and configured to allow the air to pass through an upper portion of the second cyclone and discharge the foreign substances collected by the second cyclone to the storage unit, wherein the cyclone base and the storage unit are rotatably coupled to each other via a hinge coupling portion, and wherein the vacuum cleaner further includes a rotation restraining protrusion formed in the filter unit and configured to be accommodated in a rotation restraining groove formed in the storage unit to couple the cyclone base and the storage unit.

2. The vacuum cleaner of claim 1, wherein the body comprises:

a suction motor configured to allow air to flow in one direction; and an exhaust module configured to discharge the air to the outside of the body, the air being introduced into the suction inlet and passing through the suction motor.

3. The vacuum cleaner of claim 2, wherein the dust separation module is arranged before the suction motor along a flow path of the air.

4. The vacuum cleaner of claim 1, wherein the cyclone base and the storage unit are configured to separate from each other when the storage unit is rotated in one direction with respect to the cyclone base, and the cyclone base and the storage unit are configured to remain coupled to each other when the filter unit is coupled to the second cyclone.

5. The vacuum cleaner of claim 4, wherein the filter unit comprises the rotation restraining protrusion, the storage unit includes the rotation restraining groove, and the rotation restraining protrusion is configured to be accommodated in the rotation restraining groove when the filter unit, the cyclone base, and the storage unit are coupled to one another.

6. The vacuum cleaner of claim 5, wherein the rotation restraining protrusion comprises:

an inclined portion inclined in one direction; and a movement blocker formed perpendicular to a direction in which the cyclone base and the storage unit are mutually rotated for coupling to or separation from each other, and wherein the rotation restraining groove comprises:

an inclined contact portion configured to contact the inclined portion when the cyclone base and the storage unit are rotated in a first direction such that the cyclone base and the storage unit separate from each other; and a fastener configured to contact the movement blocker when the cyclone base and the storage unit are rotated in a second direction such that the cyclone base and the storage unit are coupled to each other.

7. The vacuum cleaner of claim 6, wherein the filter unit is configured to separate from the second cyclone when the cyclone base and the storage unit are rotated in the first direction.

8. The vacuum cleaner of claim 7, wherein the second cyclone comprises a grip portion protruding upward from an upper surface of the second cyclone.

9. The vacuum cleaner of claim 1, wherein the body comprises:

a first storage configured to accommodate the foreign substances collected by the first cyclone; and a body cover formed on a lower portion of the first storage and configured to open and close the first storage.

10. The vacuum cleaner of claim 9, wherein the storage unit includes a second storage, and the body cover is configured to simultaneously open and close the first storage and the second storage.

11. The vacuum cleaner of claim 1, wherein the filter unit comprises:

a filter frame including the rotation restraining protrusion; and a main filter coupled to the filter frame and configured to surround an outer circumference of the second cyclone.

12. The vacuum cleaner of claim 1, wherein the cyclone base and the storage unit are configured to separate from each other when the cyclone base and the storage unit are mutually rotated with respect to the hinge coupling portion such that the rotation restraining protrusion of the filter unit is separated from the rotation restraining groove.

13. A vacuum cleaner comprising:

a body including a space configured to allow air to flow therethrough;

a suction inlet configured to introduce the air into the body;

a first cyclone provided in the body and configured to separate foreign substances from the air introduced into the suction inlet; and a dust separation module comprising:

a filter unit configured to separate foreign substances from the air received from the first cyclone;

a second cyclone arranged within the filter unit, the second cyclone being configured to allow the air received from the filter unit to flow through an upper portion of the second cyclone and discharge foreign substances from the air received from the filter unit to a lower portion of the second cyclone; and a storage unit configured to receive the foreign substances discharged to the lower portion of the second cyclone, wherein the dust separation module is configured to be separable from the body, and the filter unit, the second cyclone, and the storage unit are configured to be separable from one another when the dust separation module is separated from the body, wherein the second cyclone comprises:

a cyclone base; and a cyclone array coupled to the cyclone base and configured to allow the air to pass through an upper portion of the second cyclone and discharge the foreign substances collected by the second cyclone to the storage unit, wherein the cyclone base and the storage unit are rotatably coupled to each other via a hinge coupling portion, and wherein the vacuum cleaner further includes a rotation restraining protrusion formed in the filter unit and configured to be accommodated in a rotation restraining groove formed in the storage unit to couple the cyclone base and the storage unit.

14. A vacuum cleaner comprising:

a body including a space configured to allow air to flow therethrough, the body including a first body and a second body;

a suction inlet configured to introduce the air into the first body and the second body;

a suction motor provided in the first body; and a dust separation module provided in the second body, the dust separation module configured to separate foreign substances from air introduced into the suction inlet, wherein the dust separation module comprises:

a filter unit configured to separate foreign substances from the air received from a first cyclone;

a second cyclone arranged within the filter unit, the second cyclone configured to allow the air received from the filter unit to flow through an upper portion of the second cyclone and discharge foreign substances from the air received from the filter unit to a lower portion of the second cyclone; and a storage unit configured to collect the foreign substances discharged to the lower portion of the second cyclone, wherein the dust separation module is configured to be separable from the second body when the second body is separated from the first body, wherein the filter unit, the second cyclone, and the storage unit are configured to be separable from one another when the dust separation module is separated from the second body, wherein the second cyclone comprises:

a cyclone base; and a cyclone array coupled to the cyclone base and configured to allow the air to pass through an upper portion of the second cyclone and discharge the foreign substances collected by the second cyclone to the storage unit, wherein the cyclone base and the storage unit are rotatably coupled to each other via a hinge coupling portion, and wherein the vacuum cleaner further includes a rotation restraining protrusion formed in the filter unit and configured to be accommodated in a rotation restraining groove formed in the storage unit to couple the cyclone base and the storage unit.

15. The vacuum cleaner of claim 14, wherein an extension part is coupled to the suction inlet.

16. The vacuum cleaner of claim 14, wherein the second body comprises:

a body cover coupled to the second body and configured to open or close a lower surface of the second body; and a button configured to cause the body cover to open the lower surface in response to application of an external force to the button.

17. The vacuum cleaner of claim 16, wherein the second body comprises a first storage including a space between the dust separation module and an inner wall in an inner space of the second body, and the storage unit comprises a second storage including a space formed inside the storage unit, the second storage being open downward and having a width that gradually becomes narrower downward.

18. The vacuum cleaner of claim 17, wherein the body cover closes the first storage and the second storage when the lower surface of the second body is closed, and opens the first storage and the second storage when lower surface of the second body is opened.

19. The vacuum cleaner of claim 17, wherein the dust separation module is configured to be coupled to the suction motor when the dust separation module is rotated in one direction in an inner space formed by the first body and the second body, the dust separation module is configured to separate from the suction motor when the dust separation module is rotated in an opposite direction, and the dust separation module is not rotatable with respect to the suction motor when the second body is coupled to the first body.

* * * * *